United States Patent [19]

Higashi et al.

[11] Patent Number: 4,761,397

[45] Date of Patent: Aug. 2, 1988

[54] MICROCAPSULE SHEET FOR PRESSURE-SENSITIVE COPYING

[75] Inventors: Shunsaku Higashi; Shojiro Sano; Keiso Saeki, all of Shizuoka, Japan

[73] Assignee: Fuji Photo Film Co., Ltd., Kanagawa, Japan

[21] Appl. No.: 839,389

[22] Filed: Mar. 14, 1986

[30] Foreign Application Priority Data

Mar. 15, 1985 [JP] Japan ..... 60-51648

[51] Int. Cl.[4] ..... B41M 5/16

[52] U.S. Cl. ..... 503/214; 427/150; 427/151; 503/215

[58] Field of Search ..... 346/214; 427/150–152; 503/214, 215

[56] References Cited

U.S. PATENT DOCUMENTS 3,955,026 5/1976 Matsukawa et al. ..... 427/150
4,085,949 4/1978 Asao et al. ..... 427/151
4,418,942 12/1983 Hosoi et al. ..... 427/150

FOREIGN PATENT DOCUMENTS 1222187 2/1971 United Kingdom ..... 346/214
1557887 12/1979 United Kingdom ..... 346/214
1603669 11/1981 United Kingdom ..... 346/214
2087942 6/1982 United Kingdom ..... 346/214
2102855 2/1983 United Kingdom ..... 346/214

*Primary Examiner*—Bruce H. Hess
*Attorney, Agent, or Firm*—Sughrue, Mion, Zinn, Macpeak, and Seas

[57] ABSTRACT

A microcapsule-coated sheet for pressure-sensitive copying is disclosed. The microcapsule sheet comprises a base paper having thereon a layer comprising microcapsules and synthetic polymer latex having an oil swelling degree of at least 50% as a binder, and is capable of preventing the occurrence of fog during printing.

6 Claims, No Drawings

MICROCAPSULE SHEET FOR PRESSURE-SENSITIVE COPYING

FIELD OF THE INVENTION

This invention relates to a microcapsule-coated sheet (hereinafter referred to more simply as a "microcapsule sheet") for pressure-sensitive copying. More particularly, the invention relates to a microcapsule sheet for pressure-sensitive copying having a layer of microcapsules containing fine oil droplets having dissolved or dispersed therein substantially colorless electron donating dye(s).

BACKGROUND OF THE INVENTION

A pressure-sensitive recording sheet is generally composed of (1) a combination of an upper leaf (or upper paper) comprising a support having coated thereon a layer containing microcapsules prepared by dissolving substantially colorless electron donating dye(s) (hereinafter referred to as "color former(s)") in a suitable solvent and microcapsulating the oil droplets of the solution thus formed (hereinafter such microcapsules containing the oil droplets are referred to more simply as "microcapsules") and a lower leaf (or lower paper) comprising other support having coated thereon a layer of electron accepting compound (hereinafter referred to as developer); or (2) a combination of the above-described upper and lower leaves and an intermediate leaf (or intermediate paper) comprising a support having a layer of microcapsules on one surface thereof and a layer of a developer on the other surface thereof; or (3) a sheet comprising a support having microcapsules and a developer on one surface thereof in a state of being containing in one layer or in two disposed layers respectively; or (4) a sheet comprising a support containing one of microcapsules and a developer and having the other thereon as a layer coated thereon.

These pressure-sensitive recording papers are described, for example, in U.S. Pat. Nos. 2,505,470, 2,505,489, 2,550,471, 2,730,457, 3,418,250, etc.

However, conventional microcapsule sheets for pressure-sensitive copying have a serious disadvantage that they tend to form fog during printing.

A synthetic polymer latex is typically used as an adhesive and also is often used as a binder for developer layers in pressure-sensitive copying paper (pressure-sensitive recording sheet). On the other hand, a synthetic polymer latex is not generally used for a microcapsule sheet containing microcapsules prepared by a coacervation of gelatin for reasons such as that the microcapsule films become weak, etc., but a pressure-sensitive copying microcapsule sheet containing microcapsules composed of a melamine-formaldehyde resin film or a urea-formaldehyde resin film using a synthetic polymer latex as a binder is disclosed in Japanese Patent Application (OPI) No. 77589/82 (the term "OPI" as used herein refers to a "published unexamined Japanese patent application").

However, the simple use of a synthetic polymer latex as a binder does not show the effect of preventing the occurrence of fog during copying. The inventors have found that it is necessary for preventing the occurrence of fog during copying of a pressure-sensitive copying paper to use a synthetic polymer latex having an oil swelling degree with respect to diisopropylnaphthalene of at least 50% as a binder for the microcapsule sheet in synthetic polymer latexes.

SUMMARY OF THE INVENTION

The object of this invention is, therefore, to provide a microcapsule sheet for pressure-sensitive copying capable of preventing the occurrence of fog during printing.

It has now been discovered that the above-described object can be attained by the present invention as set forth hereinbelow.

That is, the invention is directed to a microcapsule sheet for pressure-sensitive copying comprising a base paper having thereon a layer comprising microcapsules and a synthetic polymer latex having an oil swelling degree with respect to diisopropylnaphthalene of at least 50% as a binder.

DESCRIPTION OF THE PREFERRED EMBODIMENTS

The oil swelling degree with respect to diisopropylnaphthalene in this invention is the value measured as follows.

A corona-discharging treatment was applied to the surface of a Teflon sheet and then an emulsion of a synthetic polymer latex was coated on the surface of the sheet and dried to form a latex film of 50 $\mu$m in thickness. The latex film was immersed in diisopropylnaphthalene (e.g., F-113, trade mark, made by Kureha Chemical Industry Co., Ltd.) in the atmosphere of 25° C. and 65% RH (relative humidity). After allowing the latex film to stand in this state for 5 hours, the weight change of the latex film was measured, and the oil swelling degree was calculated using the following equation (I)

$$\text{Oil Swelling Degree} = [(B-A)/A] \times 100 \qquad \text{(I)}$$

wherein A is the weight of the film before immersion, and B is the weight of the film after immersion.

There is no other particular restriction on the component of the synthetic polymer latex for use in this invention, and acrylic series, ester series, vinyl acetate series, vinyl chloride series, styrene-butadiene series polymers or copolymers, etc., can be used as the component. However, in these materials, a polymer or copolymer having a gel content of less than 95%, particularly less than 88%, is preferred for realizing the oil swelling degree with respect to diisopropylnaphthalene of at least 50%. Also, in the case of a copolymer of an olefin and an aliphatic conjugate diolefin such as a styrene-butadiene copolymer, it is preferred that the proportion of the aliphatic conjugate diolefin is more than 10% by weight, and particularly preferably is more than 30% by weight.

Thus, by using the synthetic polymer latex having an oil swelling degree with respect to diisopropylnaphthalene of at least 50%, preferably at least 65%, and more preferably at least 80% as a binder for a microcapsule sheet, the occurrence of fog during copying is substantially prevented. The synthetic polymer latex is preferably coated on a support in an amount of from 0.2 to 1 g/m$^2$.

In the case of using the synthetic polymer latex described above as a binder for a microcapsule sheet of this invention, it is preferred to use the synthetic polymer latex together with a water-soluble binder.

There is also no particular restriction about the color former(s) which are used for the microcapsule sheet of this invention and specific examples of the color former(s) include a triarylmethane series compound, a diphenylmethane series compound, a xanthene series compound, a thiazine compound, a spiro series compound, etc., and mixtures thereof.

The color former(s) are dissolved in a solvent, microencapsulated, and coated on a support as microcapsules. As the solvent, a natural oil, a synthetic oil, or a mixture thereof can be used. Specific examples of the solvent include cotton seed oil, kerosene, paraffin, naphthene oil, alkylated biphenyl, alkylated terphenyl, chlorinated paraffin, alkylated naphthalene, diphenylaklane, etc.

Methods for producing microcapsules containing color former(s) for use in this invention include a surface polymerization method, an internal polymerization method, a phase separation method, an external polymerization method, a coacervation method, etc., as described in U.S. Pat. Nos. 2,505,470, 2,505,489, 2,550,471, 2,730,457, 3,418,250, etc.

In the oil solution contained in the microcapsule used in the present invention, the electron donating dye is preferably contained in an amount of from 1 to 10% by weight. The electron donating dye is preferably coated on a support in an amount of from 0.1 to 0.5 g/m$^2$.

In the case of preparing a coating composition containing color former-containing microcapsules, a capsule protecting agent such as a cellulose powder, a starch powder, talc, etc., may be added in addition to the above-described binder, as described in the above U.S. patents.

Microcapsule sheets for pressure-sensitive copying according to this invention were tested using a developer sheet described below.

Preparation of Developer Sheet

A mixture of 70 parts (by weight) of water, 2 parts of zinc oxide, 18 parts of calcium carbonate, and 4 parts of zinc 3,5-di-$\alpha$-methylbenzylsalicylate was dispersed for 30 minutes by means of an attritor. To the mixture were added 2.5 parts (as solid component) of a carboxy-modified styrene-butadiene rubber latex and 12 parts by weight of an aqueous solution of 10% by weight polyvinyl alcohol (saponification degree: 99%; polymerization degree: 1,000) and the mixture was uniformly stirred to provide a coating composition. The coating composition was coated on a base paper of 50 g/m$^2$ at a solid component coverage of 4 g/m$^2$ by an air knife coater and dried to provide a developer sheet.

Then, the following examples are intended to practically illustrate this invention, but not to limit in any way.

EXAMPLE 1

In 95 parts (by weight) of hot water of about 80° C. was dissolved 5 parts of a partial sodium salt of polyvinylbenzenesulfonic acid with stirring for about 30 minutes and then the solution thus formed was cooled. The pH of the aqueous solution was in the range of from 2 to 3, and the pH thereof was adjusted to 4.0 with the addition of an aqueous solution of 20% by weight sodium hydroxide. Then, 100 parts of diisopropylnaphthalene having dissolved therein 2.5% Crystal Violet Lactone and 1.0% Benzoyl Leucomethylene Blue was dispersed by emulsification in 100 parts of the above-described aqueous solution of 5% partial sodium salt of polyvinylbenzenesulfonic acid to provide an emulsion having a mean particle size of 4.5 $\mu$m.

Apart from this, by stirring a mixture of 6 parts of melamine, 11 parts of an aqueous solution of 37% by weight formaldehyde, and 30 parts of water for 30 minutes at 60° C., a transparent aqueous solution of a mixture of melamine, formaldehyde, and a melamine-formaldehyde initial condensate was obtained. The pH of the aqueous solution thus formed was from 6.0 to 8.0. Hereinafter, the aqueous solution of a mixture of melamine, formaldehyde, and a melamine-formaldehyde initial condensate is referred to as an initial condensate solution.

The initial condensate solution obtained as described above was added to the emulsion obtained above, the pH of the resultant mixture was adjusted to 6.0 using an aqueous solution of 6% by weight hydrochloric acid with stirring, and after raising the temperature thereof to 65° C., the mixture was further stirred for 360 minutes to provide a microcapsule-containing liquid. The microcapsule liquid was cooled to room temperature, and then the pH thereof was adjusted to 9.0 with an aqueous solution of 20% by weight sodium hydroxide.

To the microcapsule dispersion thus obtained were added 100 parts of an aqueous solution of 10% by weight polyvinyl alcohol, 10 parts (as solid component) of a carboxy-modified styrene butadiene rubber latex (oil swelling degree of 89%), 50 parts of starch particles, and 10 parts of calcium carbonate and then the solid component concentration thereof was adjusted to 20% by the addition of water to provide a color former-containing microcapsule coating composition.

The coating composition was coated on a base paper of 50 g/m$^2$ at a solid component coverage of 5 g/m$^2$ and dried to provide a microcapsule sheet for pressure-sensitive copying.

EXAMPLE 2

By following the same procedure as in Example 1, except that an acrylonitrile-butadiene polymer latex (oil swelling degree of 68%) was used in place of the carboxy-modified styrene butadiene rubber latex, a microcapsule sheet for pressure-sensitive copying was obtained.

EXAMPLE 3

By following the same procedure as in Example 1, except that a vinyl-ethylene polymer latex (oil swelling degree of 100%) was used in place of the carboxy-modified pressure-sensitive copying was obtained.

EXAMPLES 4 TO 6 AND COMPARISON EXAMPLES 2 TO 4

By following the same procedure as in Example 1, except that each of the styrene butadiene rubber latexes having the compositions shown in Table 1 below was used in place of the carboxy-modified styrene butadiene rubber latex, microcapsule sheets for pressure-sensitive copying was obtained.

Each of the styrene butadiene rubber latexes was prepared by reacting the monomers shown in Table 1 for 17 hours at 70° C. in the presence of 1.0 part of potassium persulfate, 1.0 part of sodium alkylbenzenesulfonate, 0.8 part of sodium hydrogencarbonate, and 130 parts of water.

TABLE 1

| Monomer | Example 4 | Example 5 | Example 6 | Comparison Example 2 | Comparison Example 3 | Comparison Example 4 |
|---|---|---|---|---|---|---|
| Butadiene 1-3 | 27 | 35 | 30 | 33 | 45 | 38 |
| Styrene | 70 | 57 | 64 | 61 | 50 | 56 |
| Methyl methacrylate | — | 8 | — | — | — | — |
| Fumaric acid | 3 | — | 6 | 6 | — | 3 |
| Acrylic acid | — | — | — | — | 5 | — |
| 2-Hydroxyethyl acrylate | — | — | — | — | — | 3 |
| Divinylbenzene | — | — | — | — | 1 | — |
| Dodecylmercaptan | 0.4 | 0.3 | 0.5 | 0.01 | — | 0.04 |

The formation of fog during printing was tested about each of the microcapsule sheets for pressure-sensitive copying thus obtained as follows.

That is, letterpress printing was applied to the microcapsule-carrying surface of each of the microcapsule sheets prepared in the above-described examples and comparison examples, the microcapsule sheet was disposed on the developer sheet described hereinbefore so that the printed surface was in contact with the developer-carrying surface, and after applying a load of 50 g/cm$^2$ on them, they were allowed to stand for one week in an atmosphere of 25° C. and 65% RH. Thereafter, the developer sheet was separated and the state of fog was observed.

The formation of fog at printing was evaluated by the following grades.

A. No fog is observed.

B. Fog is slightly observed.

C. Fair amount of fog is observed.

D. The formation of fog is severe.

Grades A to C are suitable for practical purposes, with grades A and B being preferred.

The results thus obtained are shown in Table 2 below.

TABLE 2

| | Oil Swelling Degree (%) | Printing Fog |
|---|---|---|
| Example 1 | 89 | A |
| Example 2 | 58 | C |
| Example 3 | 100 | A |
| Comparison Example 1 | 41 | D |
| Example 4 | 80 | A |
| Example 5 | 68 | B |
| Example 6 | 83 | A |
| Comparison Example 2 | 20 | D |
| Comparison Example 3 | 33 | D |
| Comparison Example 4 | 38 | D |

TABLE 2-continued

| | Oil Swelling Degree (%) | Printing Fog |
|---|---|---|
| Example 4 | | |

As shown in Table 2 above, it can be seen that in the microcapsules for pressure-sensitive copying obtained in the examples of this invention, the formation of fog during printing is substantially prevented.

While the invention has been described in detail and with reference to specific embodiments thereof, it will be apparent to one skilled in the art that various changes and modifications can be made therein without departing from the spirit and scope thereof.

What is claimed is:

1. A microcapsule sheet for pressure-sensitive copying which comprises a base paper having thereon a layer comprising (a) microcapsules containing color former and (b) a styrene-butadiene series polymer latex having an oil swelling degree with respect to diisopropylnaphthalene of at least 68% as a binder on a base paper.

2. A microcapsule sheet as in claim 1, wherein the synthetic polymer latex has an oil swelling degree of at least 80%.

3. A microcapsule sheet as in claim 1, wherein the polymer or copolymer has a gel content of less than 95%.

4. A microcapsule sheet as in claim 1, wherein the polymer or copolymer has a gel content of less than 88%.

5. A microcapsule sheet as in claim 1, wherein the synthetic polymer latex is a copolymer of an olefin and an aliphatic conjugate diolefin, and the proportion of the aliphatic conjugate diolefin is more than 10% by weight.

6. A microcapsule sheet as in claim 1, wherein the synthetic polymer latex is a copolymer of an olefin and an aliphatic conjugate diolefin, and the proportion of the aliphatic conjugate diolefin is more than 30% by weight.

* * * * *